US006939130B2

(12) United States Patent
Abbasi et al.

(10) Patent No.: US 6,939,130 B2
(45) Date of Patent: Sep. 6, 2005

(54) HIGH-HEAT TRANSFER LOW-$NO_X$ COMBUSTION SYSTEM

(75) Inventors: Hamid A. Abbasi, Naperville, IL (US); William J. Hobson, Jr., Roscoe, IL (US); David M. Rue, Chicago, IL (US); Valeriy Smirnov, Loves Park, IL (US)

(73) Assignee: Gas Technology Institute, Des Plaines, IL (US)

( * ) Notice: Subject to any disclaimer, the term of this patent is extended or adjusted under 35 U.S.C. 154(b) by 25 days.

(21) Appl. No.: 10/729,810

(22) Filed: Dec. 5, 2003

(65) Prior Publication Data

US 2005/0123874 A1 Jun. 9, 2005

(51) Int. Cl.[7] ..... F23C 7/00

(52) U.S. Cl. ..... 431/351; 431/352; 431/187; 431/8

(58) Field of Search ..... 431/351, 352, 431/187, 181, 8, 9, 10, 12

(56) References Cited

U.S. PATENT DOCUMENTS

| | | | | |
|---|---|---|---|---|
| 4,488,866 | A * | 12/1984 | Schirmer et al. | 431/4 |
| 4,761,132 | A * | 8/1988 | Khinkis | 431/10 |
| 4,909,727 | A | 3/1990 | Khinkis | |
| 5,545,031 | A | 8/1996 | Joshi et al. | |
| 5,725,366 | A | 3/1998 | Khinkis et al. | |
| 6,663,380 | B2 * | 12/2003 | Rabovitser et al. | 431/9 |
| 6,702,571 | B2 * | 3/2004 | Abbasi et al. | 431/187 |

* cited by examiner

*Primary Examiner*—Alfred Basichas
(74) *Attorney, Agent, or Firm*—Mark E. Fejer

(57) ABSTRACT

A combustion apparatus comprising a pre-combustor stage and a primary combustion stage, the pre-combustor stage having two co-axial cylinders, one for oxidant and one for fuel gas, in which the fuel gas is preheated and the primary combustion stage having rectangular co-axial passages through which fuel and oxidant are admitted into a refractory burner block. Both passages converge in the vertical plane and diverge in the horizontal plane. The passage through the refractory burner block also has a rectangular profile and diverges in the horizontal plane. The outlets to the primary combustion stage are recessed in the refractory burner block at a distance which may be varied.

15 Claims, 3 Drawing Sheets

HIGH-HEAT TRANSFER LOW-$NO_X$ COMBUSTION SYSTEM

The U.S. Government has a paid-up license in this invention and the right in limited circumstances to require the patent owner to license others on reasonable terms as provided for by the terms of Contract No. DE-FC02-95CE41185 awarded by the U.S. Department of Energy.

BACKGROUND OF THE INVENTION

1. Field of the Invention

This invention relates to combustion systems employing burners that produce highly luminous flames, thereby providing higher heat transfer and lower $NO_x$ emissions than conventional combustion systems. More particularly, this invention relates to a method and apparatus for producing substantially flat flames which produce uniform heat distribution and relatively high radiative heat transmission. Burners employed in the combustion systems of this invention preferably use oxygen or oxygen-enriched air as an oxidant, although air may also be used.

2. Description of Related Art

Environmental requirements have been and continue to be a major impetus for developing new combustion methods and apparatuses. Manufacturers are being forced to reduce emissions, all the while striving to control costs and maintain product quality. For example, industry is faced with the need to reduce $NO_x$ emissions significantly. In response thereto, advanced combustion systems, oxygen-enrichment and oxygen-fuel combustion, are being developed. By way of example, U.S. Pat. No. 5,725,366 describes a method and apparatus for combustion of a fuel/oxidant mixture in which at least a portion of the fuel is preheated and, thereafter, burned with any remaining portion of fuel in a flame having fuel-rich zones, thereby forming soot within the resulting flame to produce a luminous, high heat transfer, low-$NO_x$ flame. See also U.S. Pat. No. 4,909,727 which describes a combustion process in which a portion of the fuel to be burned is first cracked using oxygen-enriched air to produce a cracked fuel, which includes a soot component, which is subsequently introduced into a combustion chamber with a second portion of fuel to produce a highly luminous flame.

Combustion technology involving the use of fuel-oxygen systems is relatively new in glass melting applications. Conventional burners typically employ a cylindrical burner geometry in which fuel and oxygen are discharged from a cylindrical nozzle, such as a cylindrical refractory block. Such cylindrical discharge nozzles produce a flame profile that diverges in a generally conical shape. However, conventional burners that produce generally conical flames have the undesirable tendency to produce hot spots within the furnace, resulting in furnace refractory damage, particularly to furnace crowns or roofs and sidewalls which are opposite the flame. Such conventional burners also cause increased raw material volatilization and uncontrolled emissions of nitrogen oxides, sulfur oxides and process particulates.

To address some of the problems associated with such designs, conventional burners have incorporated low momentum flow, which is produced by the use of relatively lower fuel and oxygen velocities, resulting in relatively lower momentum flames. Such lower velocities and, thus, lower momentums result in longer flames and increased load coverage. However, undesirable flame lofting occurs at such lower velocities, causing undesirable effects.

Some conventional combustion systems employ a staggered firing arrangement in an attempt to improve effective load coverage, particularly with the use of conical expansion of individual flames. However, this staggered firing arrangement often creates undesirable cold regions in pocket areas between adjacent burners. Increasing the number of burners employed, thereby increasing flame coverage, has been employed as a means for addressing this issue. However, increasing the number of burners also undesirably significantly increases the installation and operation costs. These issues are addressed, for example, by the method and apparatus of U.S. Pat. No. 5,545,031 in which a fishtail or fan-shaped flame which produces uniform heat distribution and relatively high radiative heat transmission is employed. The fuel is discharged from a nozzle in a generally planar fuel layer, forming a fishtail or fan-shaped fuel layer having generally planar upper and lower boundaries. Oxidant is discharged from the nozzle so that a generally planar oxidant layer is formed at least along the upper boundary of the fuel layer and preferably also along the lower boundary of the fuel layer.

Notwithstanding the improvements that have been made to date, there still remains a need for a burner system that can be employed in high temperature furnaces, such as glass melting furnaces, that provides uniform heat distribution, reduced undesirable emissions, such as nitrogen oxides and sulfur oxides, and which produces highly radiative and luminous flames. In addition, industrial burner operators continue to desire reliability, simplicity and low cost in the equipment employed. Typically, this means that a combustion system, in order to be accepted, must be a retrofit design, there must be only one oxygen and one fuel supply to the burner, and fuel and oxygen mixing within the preheating zone of the burner must be rapid to prevent the burner from becoming too physically large.

SUMMARY OF THE INVENTION

Accordingly, it is one object of this invention to provide a combustion system which produces a highly luminous flame.

It is another object of this invention to provide a combustion system which, in addition to producing a highly luminous flame, generates lower $NO_x$ emissions than conventional high luminosity flame combustion systems.

It is another object of this invention to provide a combustion system which, in addition to producing a highly luminous flame and generating lower $NO_x$ emissions, is also suitable for retrofitting.

It is still a further object of this invention to provide a combustion system which provides substantially uniform heat distribution and avoids the generation of hot spots within the furnace to which it is applied.

These and other objects of this invention are addressed by a combustion apparatus comprising a primary combustion stage and a pre-combustor stage. The primary combustion stage comprises rectangular co-axial passages through which fuel and oxidant are admitted into a refractory burner block. The inner passage is a fuel gas passage and the outer passage is an oxidant passage. Both passages diverge in the horizontal plane and converge in the vertical plane. The passage through the refractory burner block also has a rectangular profile and diverges in the horizontal plane. The outlets to the primary combustion stage are recessed in the refractory burner block at a distance which may be varied.

Fuel, typically a gaseous fuel, such as natural gas, is delivered to the primary combustion stage through the pre-combustor stage, which is attached to the upstream side of the primary combustion stage. The pre-combustor stage comprises two co-axial cylinders, the inner cylinder constituting an oxidant chamber and the outer cylinder constituting a fuel gas chamber. The inner cylinder is provided with at least two rows of tangential openings or ports, whereby fuel gas from the outer cylinder is permitted to flow into the inner cylinder where it mixes with oxidant and pre-combustion is initiated. Combustion product gases produced in the pre-combustor stage are discharged from the pre-combustor stage outlet into the fuel gas passage of the primary combustion stage. The upstream portion of the pre-combustor stage is connected with the main oxidant inlet to the primary combustion stage by a flexible hose or rigid conduit equipped with an integral orifice for controlling secondary oxidant entering the inner cylinder of the pre-combustor stage. Likewise, the main oxidant inlet to the primary combustor stage is also provided with an integrated orifice. By this arrangement, oxidant pressure is maintained higher than the pre-combustor stage pressure, thereby ensuring that precombustion product gases entering the primary combustion stage do not return through the oxidant inlet to the pre-combustor stage. The outer cylinder is connected with a fuel gas supply and forms an annular passage to distribute the fuel gas evenly through the tangential ports.

BRIEF DESCRIPTION OF THE DRAWINGS

These and other objects and features of this invention will be better understood from the following detailed description taken in conjunction with the drawings wherein.

DETAILED DESCRIPTION OF THE PRESENTLY PREFERRED EMBODIMENTS

Figure 1:
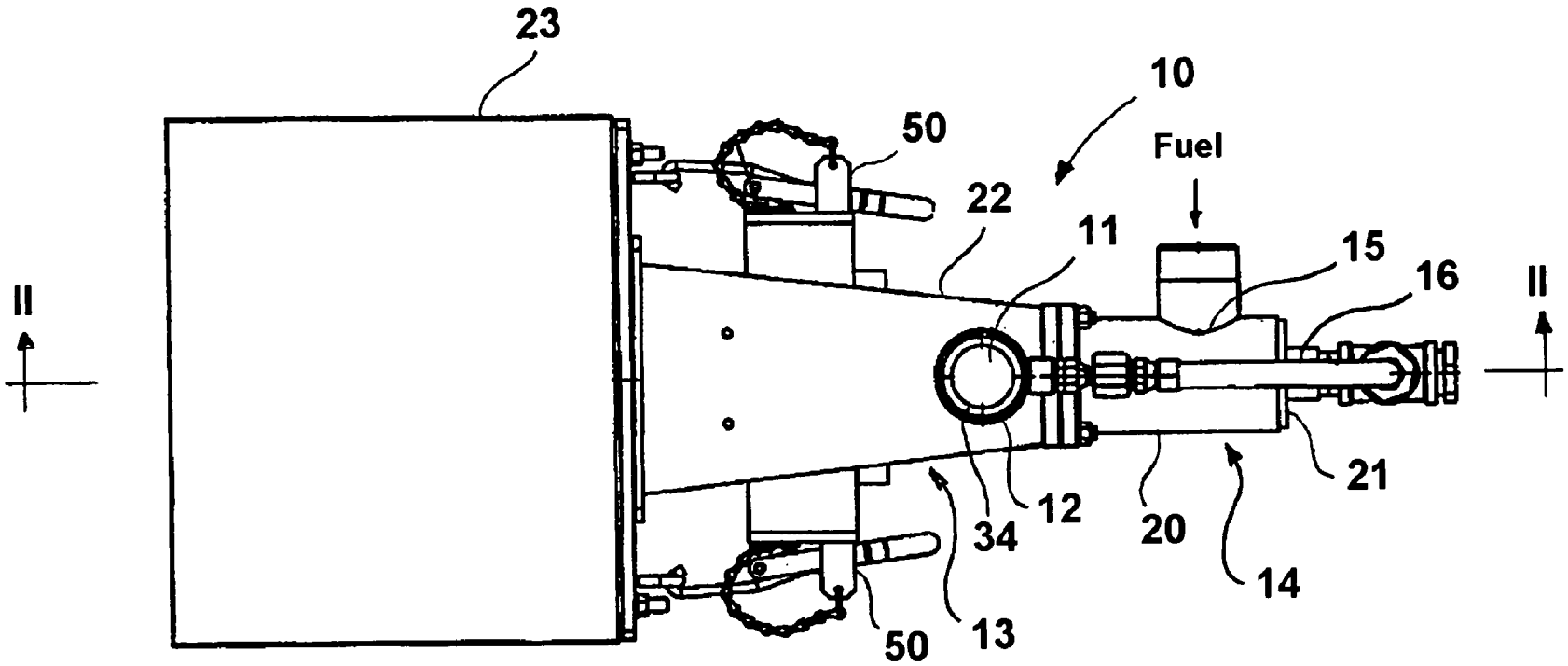
FIG. 1 is a plan view of a combustion system in accordance with one embodiment of this invention.
Figure 2:
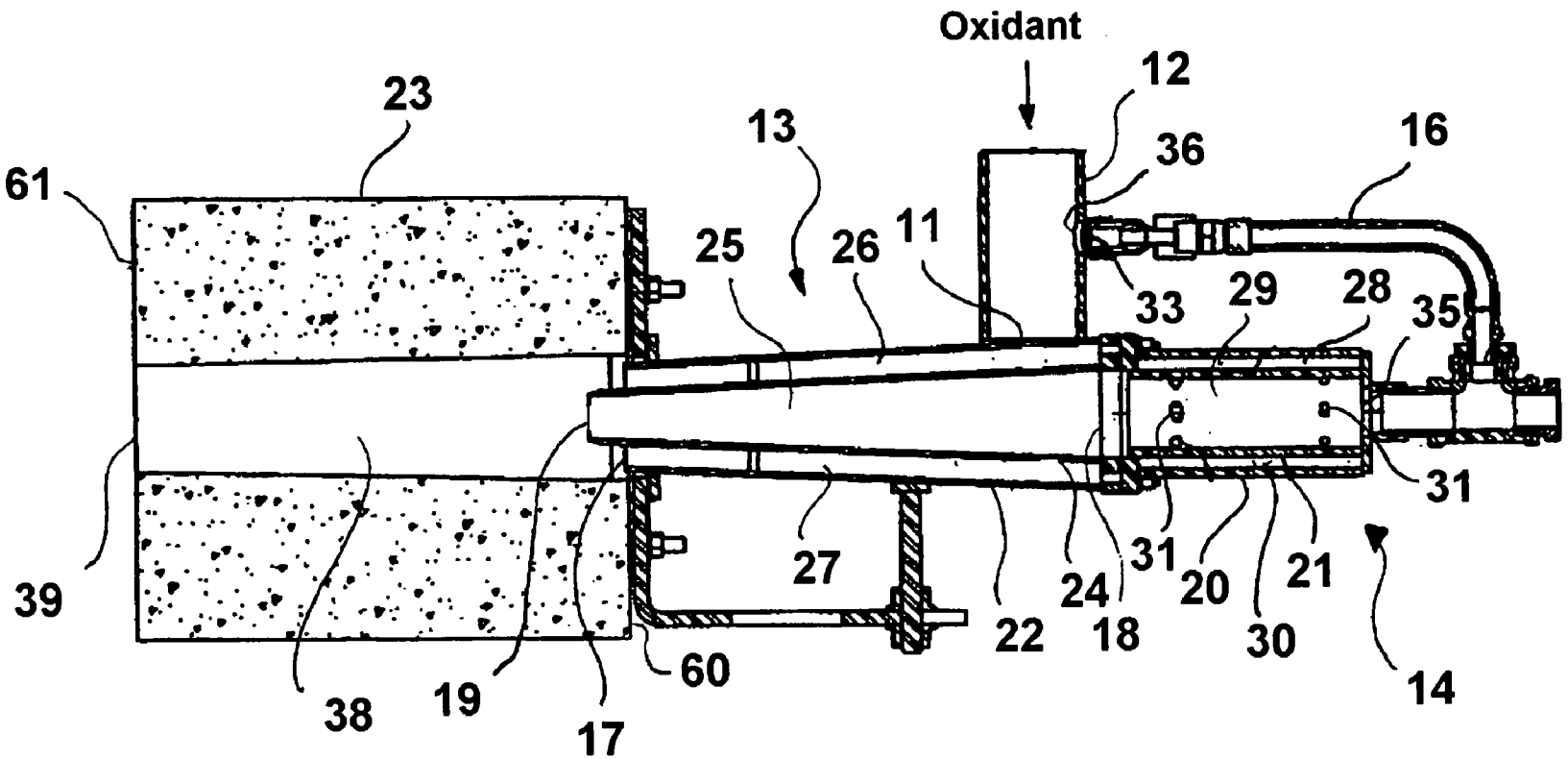
FIG. 2 is a view of the combustion system of FIG. 1 taken along the line II—II.
Figure 3:
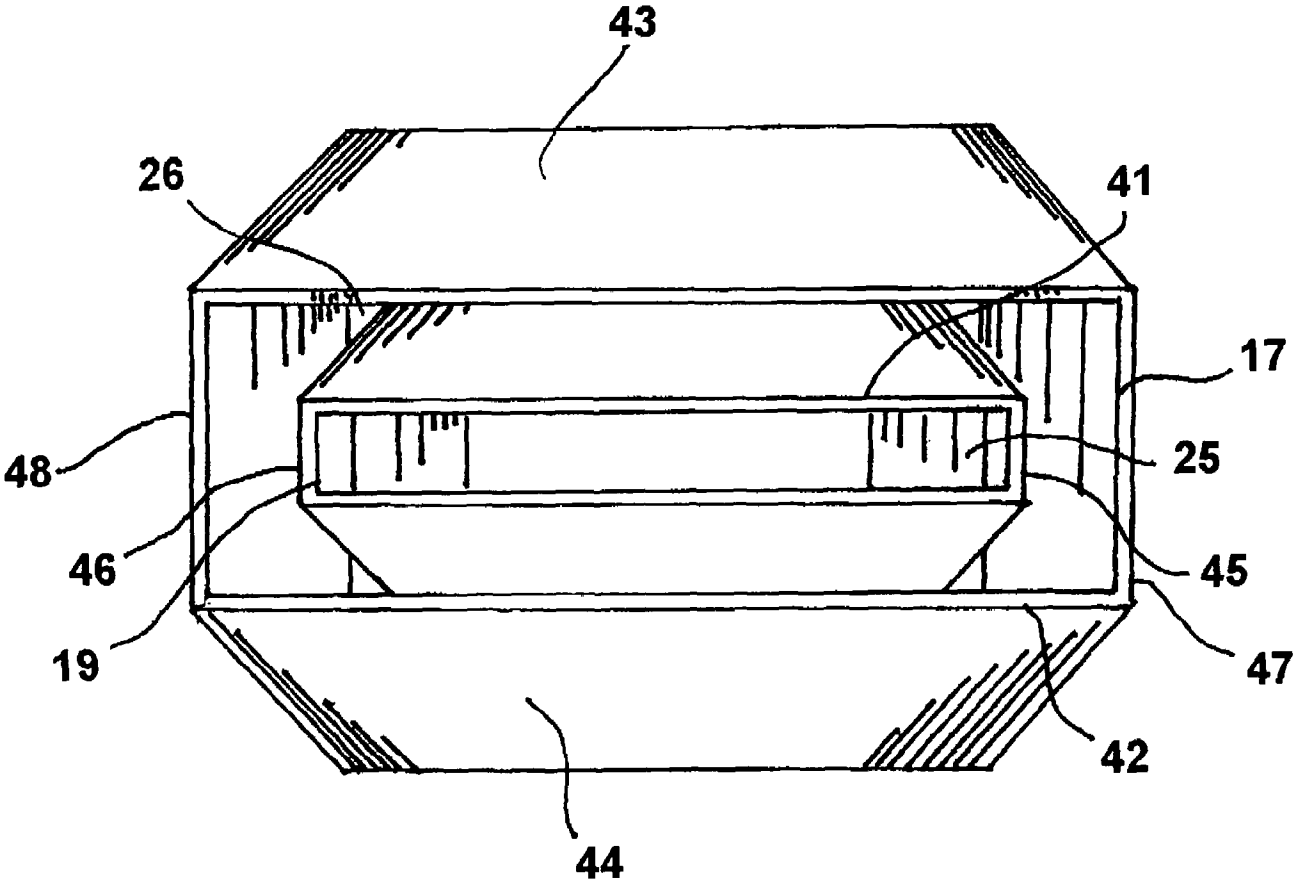
FIG. 3 is a front view of the burner discharge at an exit plane, looking in an upstream flow direction, in accordance with one embodiment of this invention.

Referring to FIGS. 1 and 2, the combustion system 10 of this invention comprises three basic components or stages—primary combustion stage 13, pre-combustor stage 14 disposed upstream of primary combustion stage 13 and burner or refractory block 23 disposed downstream of primary combustion stage 13. As used herein, the terms upstream and downstream apply generally to the direction of flow of fuel and oxidant through the system, which in FIGS. 1 and 2 is from right to left.

Primary combustion stage 13 comprises at least one outer wall 22 forming an oxidant chamber 26 having a primary oxidant inlet 11 connected to an oxidant supply conduit 12 and having a primary oxidant outlet 17. Disposed within the oxidant chamber 26 is at least one inner wall 24 forming a fuel chamber 25 having a primary fuel inlet 18, a primary fuel outlet 19 oriented in the direction of the primary oxidant outlet 17 and forming a primary annular space 27 between the at least one outer wall 22 and the at least one inner wall 24.

Pre-combustor stage 14 comprises at least one outer pre-combustor wall 20 forming a pre-combustor fuel chamber 28 having a pre-combustor fuel inlet 15. Disposed within the pre-combustor fuel chamber 28 is at least one inner pre-combustor wall 21 forming a pre-combustor oxidant chamber 29 having a pre-combustor oxidant inlet 35 and forming a pre-combustor annular space 30 between the at least one outer pre-combustor wall 20 and the at least one inner pre-combustor wall 21. The at least one inner pre-combustor wall 21 forms a plurality of pre-combustor fuel outlets 31, thereby providing fluid communication between the pre-combustor annular space 30 and the pre-combustor oxidant chamber 29. The pre-combustor fuel outlets 31 are preferably arranged in at least two rows and are oriented so as to provide a tangential flow of fuel from the pre-combustor fuel chamber 28 into the pre-combustor oxidant chamber 29, thereby creating a "spinning effect" within the pre-combustor oxidant chamber 29, effecting rapid mixing and preheating of the fuel and stable operation of the pre-combustor.

A pre-combustor oxidant supply conduit 16 connects the oxidant supply conduit 12 to the pre-combustor oxidant inlet 35, providing fluid communication between the oxidant supply conduit 12 and the pre-combustor oxidant chamber 29. In this manner, oxidant flow to both the primary combustion stage 13 and the pre-combustor stage 14 is achieved using a single oxidant supply inlet 11. It will be apparent that, because there is a fluid communication between pre-combustor oxidant chamber 29 and primary oxidant inlet 11 by way of pre-combustor oxidant supply conduit 16, there exists the potential for pre-combustion products produced in pre-combustor stage 14 to enter primary combustion stage 13 through primary oxidant inlet 11. To prevent this occurrence, a primary oxidant orifice 34 is disposed within the flow path of primary oxidant entering the primary combustion stage 13 through oxidant supply conduit 12 proximate primary oxidant inlet 11. Primary oxidant orifice 34 may be integral with oxidant supply conduit 12; it may be disposed within primary oxidant inlet 11; or it may be a separate component disposed between the outlet of oxidant supply conduit 12 and primary oxidant inlet 11. Primary oxidant orifice 34 is sized to ensure that the pressure within the primary combustion stage 13 is higher than the pressure in pre-combustor stage 14, thereby enabling the supply of pre-combustor oxidant to pre-combustor stage 14 without a possibility of flashback. In accordance with one preferred embodiment of this invention, the ratio of orifice area of primary oxidant orifice 34 to oxidant supply conduit area is in the range of about 0.4 to about 0.7. A ratio smaller than about 0.4 results in a build-up of pressure that is too high to operate the combustion system. A ratio higher than about 0.7 results in insufficient oxygen pressure to prevent the possibility of flashback in the pre-combustor.

To further control the supply of oxidant to pre-combustor stage 14, a pre-combustor oxidant orifice 33 is disposed proximate pre-combustor oxidant outlet 36 formed by oxidant supply conduit 12. As in the case of primary oxidant orifice 34, pre-combustor oxidant orifice 33 may be integral with pre-combustor oxidant supply conduit 16; it may be disposed within pre-combustor oxidant outlet 36; or it may be a separate component disposed between pre-combustor oxidant outlet 36 and pre-combustor oxidant supply conduit 16. Pre-combustor oxidant orifice 33 is effective for controlling the pre-combustor stage operation, thereby controlling the formation of soot hydrocarbon precursors and flame luminosity. Preferably, pre-combustor oxidant orifice 33 is sized to admit in the range of about 2.5% to about 8% of the total amount of oxidant consumed by the combustion system 10 to the pre-combustor stage 14. Less than about 2.5% is insufficient to support combustion in the pre-combustor stage 14 whereas more than about 8% results in excessive carbon deposition on the combustion system elements and leads to excessive combustion system temperatures. Although stable, long-term combustion by the combustion system may be sustained without employing the pre-combustor stage 14, the resulting flame is much less luminous, more fuel is required to reach the same levels of heat transfer and more nitrogen oxides are created. It will be appreciated by those skilled in the art that other means of primary oxidant flow control and pre-combustor oxidant flow control, e.g. valves, may be employed in place of the above-described orifices and such other means are deemed to be within the scope of this invention.

To establish the desired velocities and momentum to balance desired levels of mixing, desired rate of fuel and oxygen reaction, and desired flame length and shape, fuel chamber 25 is formed between horizontally oriented substantially planar inner walls 41, 42 converging with respect to each other and vertical inner walls 45, 46 diverging with respect to each other, forming a substantially rectangular said primary fuel outlet 19, and the oxidant chamber 26 is formed between horizontally oriented substantially planar outer walls 43, 44 converging with respect to each other and vertical outer walls 47, 48 diverging with respect to each other, forming a substantially rectangular primary oxidant outlet 17.

In accordance with one preferred embodiment of this invention, vertical inner walls 45, 46 and vertical outer walls 47, 48 diverge with respect to each other at an angle in the range of about 14° to about 18° in the horizontal plane. Less than a 14° angle causes an undesirable increase in outlet velocity, greater flame turbulence and shortening of the flame, which translates to less load area coverage and correspondingly lower total heat transfer. More than an 18° angle causes excessive flame widening and shortening, which also translates to less load area coverage and correspondingly lower total heat transfer.

In accordance with one preferred embodiment of this invention, horizontally oriented substantially planar inner walls 41, 42 and horizontally oriented substantially planar outer walls 43, 44 have a convergence angle in the range of about 3° to about 5°. Less than a 3° angle results in undesirable thicker and slower flames, which translates to a flame envelope that is less focused on the load surface and lower total heat transfer. More than about a 5° angle results in the flame becoming thinner and less stable with respect to cross flow from combustion product gases in the furnace.

In accordance with one preferred embodiment, combustion system 10 is provided with four clamps 50, only two of which are shown in FIG. 1, for mounting the combustion system on refractory block 23. This allows the system to be rotated 180° (or turned upside down) so that the oxidant can be supplied to the top or bottom of the system. The pre-combustor stage 14 can also be rotated a full 360°, allowing the primary fuel inlet 18 to be on the left, right, top or bottom positions.

Combustion system operation is initiated by starting the system at low fire. First the oxidant valve is opened followed by the fuel valve. Heat for ignition of the fuel/oxidant mixture is supplied by furnace radiation (at temperatures greater than about 1650° F.). At lower temperatures, an external ignition source is required. However, because the contemplated application of the combustion system of this invention is high temperature industrial furnaces that are already in operation, external ignition will normally not be required.

Shortly after ignition, re-radiation and back flow cause the flame, which is initially disposed in the primary combustion stage, to move back through the primary combustion stage into the pre-combustor stage, thereby igniting a fuel/oxidant mixture present in the pre-combustor oxidant chamber 29 of the pre-combustor stage 14. Fuel gas is delivered by way of the pre-combustor fuel chamber 25 to the tangential pre-combustor fuel inlets 31 with sufficient pressure to establish a spinning momentum within pre-combustor oxidant chamber 29 of pre-combustor stage 14. A small portion of the total oxidant flow to the combustion system (about 2.5% to about 8% of the total oxidant flow) is introduced into pre-combustor oxidant chamber 29 in which it gradually mixes with fuel gas entering pre-combustor oxidant chamber 29 through pre-combustor fuel inlets 31.

As previously stated, inner pre-combustor wall 21 forms at least two rows of pre-combustor fuel inlets 31. By virtue of this arrangement, mixing of the fuel gas and pre-combustor oxidant within the pre-combustor stage is controlled. In accordance with one particularly preferred embodiment of this invention, inner pre-combustor wall 21 forms two rows of pre-combustor inlets 31 and approximately 10–50% of the fuel gas entering pre-combustor oxidant chamber 29 is introduced through the upstream row of inlets and the remaining portion of fuel gas is introduced through the downstream row of inlets 31. In accordance with another preferred embodiment, inner pre-combustor wall 21 forms at least three rows of pre-combustor fuel inlets 31 and at least 10% of the fuel gas entering pre-combustor oxidant chamber 29 is introduced through each of the rows.

After the pre-combustor stage 14 has been ignited from heat supplied by furnace re-radiation (or by some external ignition source), a very fuel-rich flame with hydrocarbon compounds with two to sixteen carbon atoms and free carbon particles is produced. This mixture of fuel gas, products of incomplete combustion and free carbon particles then moves through primary fuel inlet 18 into fuel chamber 25 and through primary fuel outlet 19, at which point it mixes with oxidant passing from oxidant chamber 26 through primary oxidant outlet 17 and into fuel/oxidant conduit or channel 38 of refractory block 23.

The reactions of oxidant and preheated fuel gas containing products of reaction from the pre-combustor stage produce parallel flow paths that create a long, flat, turbulent and highly luminous flame envelope outside the discharge 39 of refractory block 23. The angle of fuel/oxidant conduit or channel 38 extending through refractory block 23 between fuel/oxidant inlet side 60 and fuel/oxidant outlet side 61 is selected to control oxidant and preheated fuel gas interaction within the refractory block. Oxidant traveling through the refractory block along the channel walls keeps the refractory block relatively cool compared to the flame temperature, thereby preserving refractory block integrity. The shape of the expanding channel delays interaction between the oxidant and the preheated fuel gas. However, some interaction does occur, producing an inner fuel-rich zone in which soot is created from the soot hydrocarbon precursors already present in the preheated fuel gas. (Hydrocarbon precursors to soot are formed by heat in the absence of oxygen during the fuel gas preheating process in the pre-combustor stage.) The remaining preheated fuel gas burns with the remaining oxidant outside of the refractory block to form a fuel-lean flame zone. Soot radiation and burnout in the flame significantly increase overall flame luminosity and lead to a decrease in flame temperature by radiative cooling. The more highly luminous flame delivers a higher radiant heat flux to the load. Lower average flame temperature decreases the formation of undesirable nitrogen oxides. This burner design thereby leads simultaneously to a decrease in nitrogen oxides emissions and a savings in energy because less fuel gas and oxidant are required to heat the furnace load. In a situation in which the capacity of a furnace and the temperatures in the furnace are not changed, this burner will require less fuel gas and oxidant compared with other burners.

While in the foregoing specification this invention has been described in relation to certain preferred embodiments thereof, and many details have been set forth for the purpose of illustration, it will be apparent to those skilled in the art that the invention is susceptible to additional embodiments and that certain of the details described herein can be varied considerably without departing from the basic principles of this invention.

We claim:

1. An apparatus comprising:

a primary combustion stage comprising at least one outer wall forming an oxidant chamber having a primary oxidant inlet connected to an oxidant supply conduit and a primary oxidant outlet and at least one inner wall forming a fuel chamber disposed within said oxidant chamber having a primary fuel inlet and a primary fuel outlet oriented in a direction of said primary oxidant outlet, forming a primary annular space between said at least one outer wall and said at least one inner wall;

a pre-combustor stage comprising at least one outer pre-combustor wall forming a pre-combustor fuel chamber having a pre-combustor fuel inlet and at least one inner pre-combustor wall forming a pre-combustor oxidant chamber having a pre-combustor oxidant inlet disposed within said pre-combustor fuel chamber and forming a pre-combustor annular space between said at least one outer pre-combustor wall and said at least one inner pre-combustor wall, said at least one inner pre-combustor wall forming a plurality of pre-combustor fuel outlets, providing fluid communication between said pre-combustor annular space and said pre-combustor oxidant chamber; and a pre-combustor oxidant supply conduit having one end connected to said oxidant supply conduit and an opposite end connected to said pre-combustor oxidant inlet, providing fluid communication between said oxidant supply conduit and said pre-combustor oxidant chamber.

2. An apparatus in accordance with claim 1 further comprising a primary oxidant flow control means proximate said primary oxidant inlet for controlling primary oxidant flow into said primary oxidant chamber.

3. An apparatus in accordance with claim 1 further comprising a pre-combustor oxidant flow control means disposed between said oxidant supply conduit and said pre-combustor oxidant inlet for controlling pre-combustor oxidant flow into said pre-combustor oxidant chamber.

4. An apparatus in accordance with claim 2, wherein said primary oxidant flow control means comprises a primary oxidant orifice disposed one of within said oxidant supply conduit and at an oxidant supply conduit end proximate said primary oxidant inlet, said primary oxidant orifice sized to maintain primary oxidant pressure in said oxidant supply conduit higher than a pre-combustor pressure in said pre-combustor stage.

5. An apparatus in accordance with claim 3, wherein said pre-combustor oxidant flow control means comprises a pre-combustor oxidant orifice disposed one of within and at a pre-combustor oxidant supply conduit of said pre-combustor oxidant supply conduit.

6. An apparatus in accordance with claim 1, wherein said fuel chamber is formed between horizontally oriented substantially planar said inner walls converging with respect to each other and vertical said inner walls diverging with respect to each other, forming a substantially rectangular said primary fuel outlet, and said oxidant chamber is formed between horizontally oriented substantially planar said outer walls converging with respect to each other and vertical said outer walls diverging with respect to each other, forming a substantially rectangular primary oxidant outlet.

7. An apparatus in accordance with claim 1 further comprising a refractory block having a fuel/oxidant inlet side, a fuel/oxidant outlet side and forming a fuel/oxidant conduit extending therebetween, said fuel/oxidant conduit having a rectangular profile which diverges in a horizontal plane and is aligned with said primary oxidant outlet.

8. An apparatus in accordance with claim 1, wherein said pre-combustor fuel outlets are oriented to introduce fuel from said pre-combustor fuel chamber into said pre-combustor oxidant chamber in a tangential direction.

9. An apparatus in accordance with claim 7, wherein at least one of said primary fuel outlet and said primary oxidant outlet extend into said fuel/oxidant conduit.

10. An apparatus in accordance with claim 8, wherein said pre-combustor fuel outlets are arranged into at least two rows.

11. A burner comprising:

a primary combustion stage comprising co-axial outer and inner rectangular passages, said outer rectangular passage having an oxidant inlet and an oxidant outlet and said inner rectangular passage having a fuel inlet and a fuel outlet, said fuel outlet oriented proximate said oxidant outlet;

a pre-combustor stage disposed upstream of said primary combustion stage comprising co-axial inner and outer cylinders, said inner cylinder having a pre-combustor oxidant inlet, a pre-combustion products outlet in fluid communication with said fuel inlet, and a plurality of tangential openings providing fluid communication between said outer cylinder and said inner cylinder, and said outer cylinder having at least one pre-combustion fuel inlet; and a pre-combustor oxidant conduit having a pre-combustor oxidant conduit oxidant inlet in fluid communication with said oxidant inlet and a pre-combustor oxidant conduit oxidant outlet in fluid communication with said pre-combustor oxidant inlet.

12. A burner in accordance with claim 11, wherein each of said inner rectangular passage and said outer rectangular passage comprises horizontally oriented substantially planar walls converging with respect to each other and vertical walls diverging with respect to each other.

13. A burner in accordance with claim 12 further comprising a refractory block having a fuel/oxidant inlet side, a fuel/oxidant outlet side and forming a fuel/oxidant conduit extending therebetween, said fuel/oxidant conduit having a rectangular profile which diverges in a horizontal plane and is aligned with said oxidant outlet.

14. A burner in accordance with claim 12 further comprising an oxidant flow control means proximate said oxidant inlet for controlling oxidant flow into said outer rectangular passage.

15. A burner in accordance with claim 12 further comprising a pre-combustor oxidant flow control means disposed between said oxidant inlet and said pre-combustor oxidant inlet for controlling pre-combustor oxidant flow into said inner cylinder.

* * * * *